US007748462B2

(12) United States Patent
Reid

(10) Patent No.: US 7,748,462 B2
(45) Date of Patent: Jul. 6, 2010

(54) ACTUATING MECHANISM

(75) Inventor: Michael Adam Reid, Aberdeen (GB)

(73) Assignee: Red Spider Technology Limited, Aberdeen (GB)

( * ) Notice: Subject to any disclaimer, the term of this patent is extended or adjusted under 35 U.S.C. 154(b) by 0 days.

(21) Appl. No.: 12/319,795

(22) Filed: Jan. 12, 2009

(65) Prior Publication Data

US 2009/0159266 A1 Jun. 25, 2009

Related U.S. Application Data

(62) Division of application No. 10/579,274, filed as application No. PCT/GB2004/004745 on Nov. 12, 2004.

(30) Foreign Application Priority Data

Nov. 13, 2003 (GB) ..... 0326457.9

(51) Int. Cl.
*E21B 34/10* (2006.01)
*E21B 33/12* (2006.01)

(52) U.S. Cl. ..... 166/323; 166/319; 166/373; 166/374

(58) Field of Classification Search ..... 166/319, 166/321, 323, 373, 374, 375
See application file for complete search history.

(56) References Cited

U.S. PATENT DOCUMENTS 5,490,564 A 2/1996 Schultz et al.
7,281,584 B2 * 10/2007 McGarian et al. ..... 166/323
7,331,392 B2 * 2/2008 Bosley et al. ..... 166/323
2002/0046834 A1 4/2002 Rayssiguier et al.

FOREIGN PATENT DOCUMENTS

| | | |
|---|---|---|
| EP | 0485243 | 5/1992 |
| GB | 2281752 | 3/1995 |
| WO | WO-01/83939 | 11/2001 |

OTHER PUBLICATIONS

International Preliminary Report on Patentability dated Nov. 23, 2007.
International Search Report dated Mar. 8, 2005.

* cited by examiner

*Primary Examiner*—Jennifer H Gay
*Assistant Examiner*—Brad Harcourt
(74) *Attorney, Agent, or Firm*—Edwards Angell Palmer & Dodge LLP; David J. Silvia, Esq.

(57) ABSTRACT

An actuating mechanism for use in a tool such as a plug used in oil and gas wells. The mechanism being operable under pressure in the well bore to set the plug in a first natural closed state for a pressure under a predetermined pressure range; a second closed state wherein the plug is locked closed regardless of the pressure; and a third open state by increasing the pressure to the predetermined pressure range and holding the pressure in the range for a predetermined time. Electronic and mechanical, dual piston, actuating mechanisms are described as is a method of controlling fluid flow in a well bore using the plug and performing a pressure test against the plug.

9 Claims, 15 Drawing Sheets

ACTUATING MECHANISM

CROSS REFERENCE TO RELATED APPLICATIONS

This application is a divisional application of U.S. patent application Ser. No. 10/579,274 which was filed on Oct. 26, 2006 and is the U.S. national phase, pursuant to 35 U.S.C. §371, of international application No. PCT/GB2004/004745, filed Nov. 12, 2004 published in English on Jun. 9, 2005 as international publication No. WO 2005/052302 A2, which claims the benefit of British application Ser. No. GB 0326457.9, filed Nov. 13, 2003, the disclosure of which applications are incorporated herein in their entireties by this reference.

BACKGROUND OF THE INVENTION

1. Field of the Invention

The present invention relates to plugs used in oil and gas wells and in particular, though not exclusively, to an actuating mechanism which provides for controlled opening of a plug.

2. Description of Related Art

During the lifetime of an oil/gas production well, various servicing operations will be carried out to the well to ensure that the efficiency and integrity of the well is maximised. This would include; a full work over, surface well-head tree change, side tracking or close proximity drilling operations. To allow any of these operations to be done safely and to accommodate verification pressure tests from surface, it is necessary to install a plug (or plugs) into the production tubing to create a barrier to both test against and provide isolation from the production zones.

These plugs are typically installed/retrieved from the well bore by either wire line or coiled tubing methods. Wire line and coiled tubing operations however, can be time consuming and risky depending on the application, and are generally kept to a minimum where possible. When retrieving plugs it is necessary to equalise pressure above and below prior to unlocking and removal—this often involves an extra intervention run to initiate equalisation prior to retrieval.

One type of plug developed to remove the requirement for intervention is referred to as a pump open plug. This device is equalised by applying pressure to the tubing above the plug to a pre-determined value. This causes a specially rated shear pin to fail, actuating the device to communicate pressure between the tubing above and below the plug. Retrieval of the plug can then commence, or the plug left in situ and the well produces through the now open plug. This is a simple design which can be equalised remotely by pressure from the surface. It can also handle over balanced situations i.e. the pressure below the plug is always less than that above due to the hydrostatic weight of fluid above being greater than the zonal pressure below the plug.

However, this plug does have a number of disadvantages, namely that it does not allow for a full pressure test of the production tubing above the plug as the shear pin rating inherently has to be less than the production tubing's pressure rating. There is also a need to know what the expected pressure below the plug will be prior to opening as this is important when rating the shear pin. Additionally, the over balance conditions permanently load up the shear pin. Shear pins are inherently difficult to manufacture accurately and the shear pin used cannot be tested prior to installation. When the shear pin fails during opening operations the pressure can surge into the zonal formation causing formation damage within the well.

Pressure cycle plugs have also been developed. Such designs are those disclosed in GB 2,281,752 and EP 0,485,243. These are generally referred to as pressure cycle plugs. In such devices the pressure is equalised by applying, from surface, a predetermined number of pressure cycles (pressure up-bleed off). The actual value of pressure applied is less important than that of the pump open plug, it equivalently just needs to be more than the pressure below the plug. During each cycle applied, the equalisation mechanism with the device moves incrementally typically via a ratchet. On the last cycle the mechanism will finally move to a position that will allow communication to occur between the tubing above the plug to that below. Again retrieval of the plug can then commence, or the plug left in situ and the well produced with the now open plug. These plugs are advantageous in that the pressure can be equalised remotely from the surface. The value of the pressure applied is less critical than that needed for operating a pump open plug and the number of pressure cycles can be pre-set before the plug is installed, to allow enough scope to do all the pressure testing etc prior to opening. The plug will open during the bleed off phase of the pressure cycle and thus pressure surges to the formation are minimised. The tubing above the plug can be tested to the maximum pressure rating and then cycled open to a lower pressure.

While the pressure cycle plug has these advantages, it also has a number of disadvantages. A major disadvantage is that by virtue of the fact that a predetermined amount of cycles have to be undertaken before opening, this can be restrictive in well operations. Often during surface operations, pressures may be applied inadvertently to the tubing and it becomes confusing as to whether they constituted a cycle or not, therefore it becomes less clear how many cycles are left to open the plug. In order to operate the plug a knowledge of the pressure below the plug is required. Because the plug opens during bleed-off, it is not easy to tell if the plug was closed or open until the next cycle is applied. Therefore it is never clear if the plug is really closed without using up another cycle. Shock loading during installation of the plug can cause the internal mechanism to incrementally move, thus using up some cycles without knowledge by the operator. The internal mechanisms are not particularly suitable for use in over balance situation due to the hydrostatic weight of fluid above being greater than the zonal pressure below the plug.

SUMMARY OF THE INVENTION

It is an object of at least one embodiment of the present invention to provide a plug for use in an oil or gas well which overcomes at least some of the disadvantages of the prior art plugs.

It is an object of at least one embodiment of the present invention to provide an actuating mechanism for use in a plug which overcomes at least some of the disadvantages of the prior art plugs.

According to a first aspect of the present invention there is provided a plug for controlling fluid flow in a well bore, the plug comprising a substantially cylindrical body adapted for location on a work string, the body including a bore through a portion thereof and one or more radial ports for passage of fluid from the bore to an outer surface of the body, an actuating member moveable relative to the body so as to cover the one or more radial ports in a first position and uncover the one or more radial ports in a second position wherein movement of the actuating member is controlled by an actuating mechanism, the mechanism being operable under pressure in the well bore to set the plug in a first natural state wherein the actuating member is in the first position for a pressure under a predetermined pressure range; a second closed state wherein the actuating member is locked in the first position regardless of the pressure; and a third open state wherein the actuating member is moved to the second position on increasing the pressure to the predetermined pressure range and holding the pressure in the range for a predetermined time.

Thus the plug can only be opened if the plug begins in the natural state, the pressure is brought up to a predetermined range an held in this range for a given time period. The actuating mechanism can be considered as a timed release actuating mechanism. A rapid increase of pressure will merely lock the plug in the closed state and any pressure variation thereafter will hold the plug in the closed state. With the plug 'locked out' pressure testing can advantageously be carried out above the plug in the well bore.

Preferably the bore provides communication with the work string such that the plug may be operated by pressure applied from a surface of the well bore.

Preferably the actuating mechanism is located in the bore.

Preferably the predetermined range for the pressure is approximately 1200 to 1800 psi.

Preferably the actuating mechanism comprises one or more pistons operated on by the applied pressure. More preferably the actuating mechanism comprises first and second pistons; the first piston including a damping element for delaying movement of the first piston relative to the second piston under the applied pressure; the second piston acting on a retaining element; the retaining element adapted to hold the second piston in an intermediate position when the applied pressure is within the predetermined range and allow movement of the first piston to a final position; the retaining element allowing the second piston to move to a secondary position when the applied pressure is above the predetermined range; a locking element which prevents movement of the first piston when the second piston is in the secondary position; and a securing element for retaining the actuating member in the first position until released by virtue of the first piston reaching the final position, whereby the actuating member moves to the second position and opens the plug.

Thus when a pressure is applied the pistons will move. By virtue of the damping element the first piston will move slower than the second piston. When the pressure reaches the predetermined range, the second piston is held in an intermediate position. If the first piston reaches its final position the actuating member will move and the plug will operate. If the pressure increases above the predetermined range before the first piston reaches its final position, the second piston 'locks out' the first piston and the actuating member remains in the first position. Thus holding the pressure in the intermediate range for sufficient time allows the first piston to move from its starting position to its final position without being 'locked-out' and will cause the actuating member to move and open the plug.

Preferably the first and second pistons include drive faces upon which the applied pressure acts. More preferably the drive faces are substantially conical with apexes directed towards the applied pressure.

Preferably the drive faces of the pistons are initially located in the bore. Advantageously the pistons are arranged longitudinally to the body. Optionally the pistons are in parallel alignment.

Preferably the damping element is a fluid metering device. Preferably the fluid metering device comprises a fluid filled chamber through which the first piston passes. Preferably within the chamber a portion of the first piston includes a restrictor to regulate fluid flow between upper and lower compartments of the chamber. Preferably also a portion of the first piston includes a check valve to allow fluid to be selectively moved between the compartments.

Advantageously a pressure balance piston is located in the chamber. The pressure balance piston may be arranged around the first piston to control the size of the chamber in order to compensate for thermal effects and pressure differences between inside and outside the chamber.

Preferably the retaining element is a spring. The retaining element may be a leaf spring. More preferably the retaining element is a collet. Preferably the locking element is a sleeve. The retaining element and the locking element may engage to control movement of the pistons.

Optionally, the actuating mechanism may comprise a pressure sensor located in the bore to measure the applied pressure, a processor programmed to control a motor in response to the pressure wherein operation of the motor causes the required relative movement between the actuating member and the body.

In this embodiment, the processor is a logic processor programmed to perform the steps required to operate the plug. The mechanism may further comprise a pressure transducer and a battery pack. The motor may drive a ball screw located between the body and the actuating member. The mechanism may also comprise a securing element for retaining the actuating member in the first position.

Preferably the actuating member is a sleeve. The sleeve may be arranged around a body of the tool.

Preferably the securing element is one or more locking keys which engage with the sleeve. The keys may engage the sleeve when the sleeve is in the first and second positions to prevent unwanted movement of the sleeve.

According to a second aspect of the present invention there is provided an actuating mechanism for operating a tool used in a well bore, the mechanism comprising first and second pistons; the first piston including a damping element for delaying movement of the first piston relative to the second piston under an applied pressure; the second piston acting on a retaining element; the retaining element adapted to hold the second piston in an intermediate position when the applied pressure is within a predetermined range and allow movement of the first piston to a final position; the retaining element allowing the second piston to move to a secondary position when the applied pressure is above the predetermined range; a locking element which prevents movement of the first piston when the second piston is in the secondary position; an actuating member whose movement operates the tool; and a securing element for retaining the actuating member in a first position until released by virtue of the first piston reaching the final position, whereby the actuating member moves to a second position and operates the tool.

Thus when a pressure is applied the pistons will move. By virtue of the damping element the first piston will move slower than the second piston. When the pressure reaches the predetermined range, the second piston is held in an intermediate position. If the first piston reaches its final position the actuating member will move and the plug will operate. If the pressure increases above the predetermined range before the first piston reaches its final position, the second piston 'locks out' the first piston and the actuating member remains in the first position. Thus holding the pressure in the intermediate range for sufficient time allows the first piston to move from its starting position to its final position without being 'locked-out' and will cause the actuating member to move and operate the tool.

Preferably the first and second pistons include drive faces upon which the applied pressure acts. More preferably the drive faces are substantially conical with apexes directed towards the applied pressure.

Preferably the damping element is a fluid metering device. Preferably the fluid metering device comprises a fluid filled chamber through which the first piston passes. Preferably within the chamber a portion of the first piston includes a restrictor to regulate fluid flow between upper and lower compartments of the chamber. Preferably also a portion of the first piston includes a check valve to allow fluid to be selectively moved between the compartments.

Advantageously a pressure balance piston is located in the chamber. The pressure balance piston may be arranged around the first piston to control the size of the chamber in order to compensate for thermal effects and pressure differences between inside and outside the chamber.

Preferably the retaining element is a spring. The retaining element may be a leaf spring. More preferably the retaining element is a collet. Preferably the locking element is a sleeve. The retaining element and the locking element may engage to control movement of the pistons.

Preferably the actuating member is a sleeve. The sleeve may be arranged around a body of the tool. Preferably the securing element is one or more locking keys which engage with the sleeve. The keys may engage the sleeve when the sleeve is in the first and second positions to prevent unwanted movement of the sleeve.

According to a third aspect of the present invention there is provided a controlling fluid flow in a well bore, the method comprising the steps:

(a) locating a plug in a well bore, the plug including an actuating mechanism to operate the plug;

(b) increasing pressure from a surface of the well bore to within a predetermined range; and (c) keeping the pressure within the predetermined range over sufficient time to cause the actuating mechanism to move and open the plug.

Preferably the plug is according to the first aspect.

Preferably the method includes the step of applying pressure above the predetermined range.

Preferably the method includes the step of locking the plug in a closed position in the event that the pressure exceeds the predetermined range.

The method may then include the step of performing a pressure test above the plug.

Preferably also the method includes the step of bringing the pressure back down to below the predetermined range to then perform steps (b) and (c) to open the plug.

It will be appreciated that where reference is given to the terms 'up' and 'down' this is relative and the invention could equally well be applied in deviated or horizontal well bores where the references would convert accordingly.

BRIEF DESCRIPTION OF THE DRAWINGS

Embodiments of the present invention will now be described, by way of example only, with reference to the following drawings of which.

DETAILED DESCRIPTION OF PREFERRED EMBODIMENTS

Figure 1A:
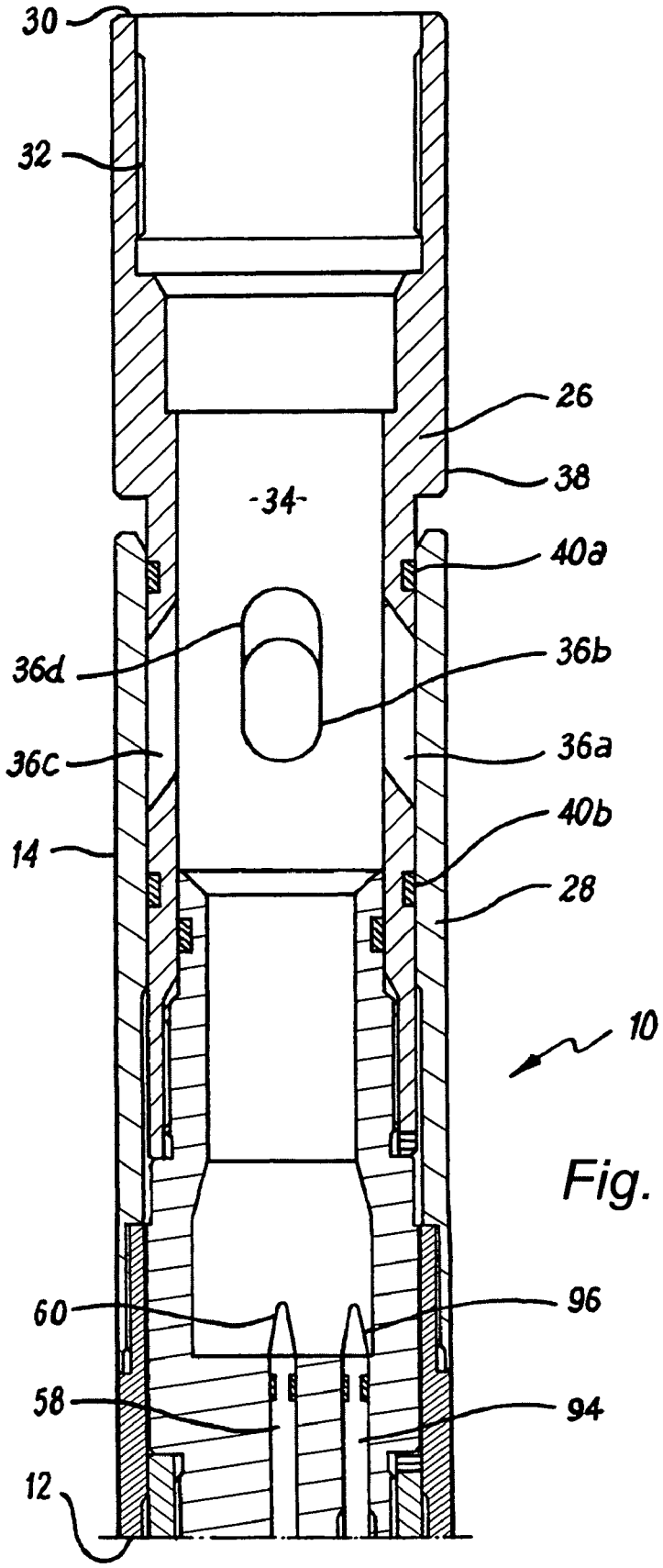
FIG. 1 is a cross-sectional view of plug in parts (*a*), (*b*) and (*c*) according to an embodiment of the present invention, in the natural state.
Figure 1B:
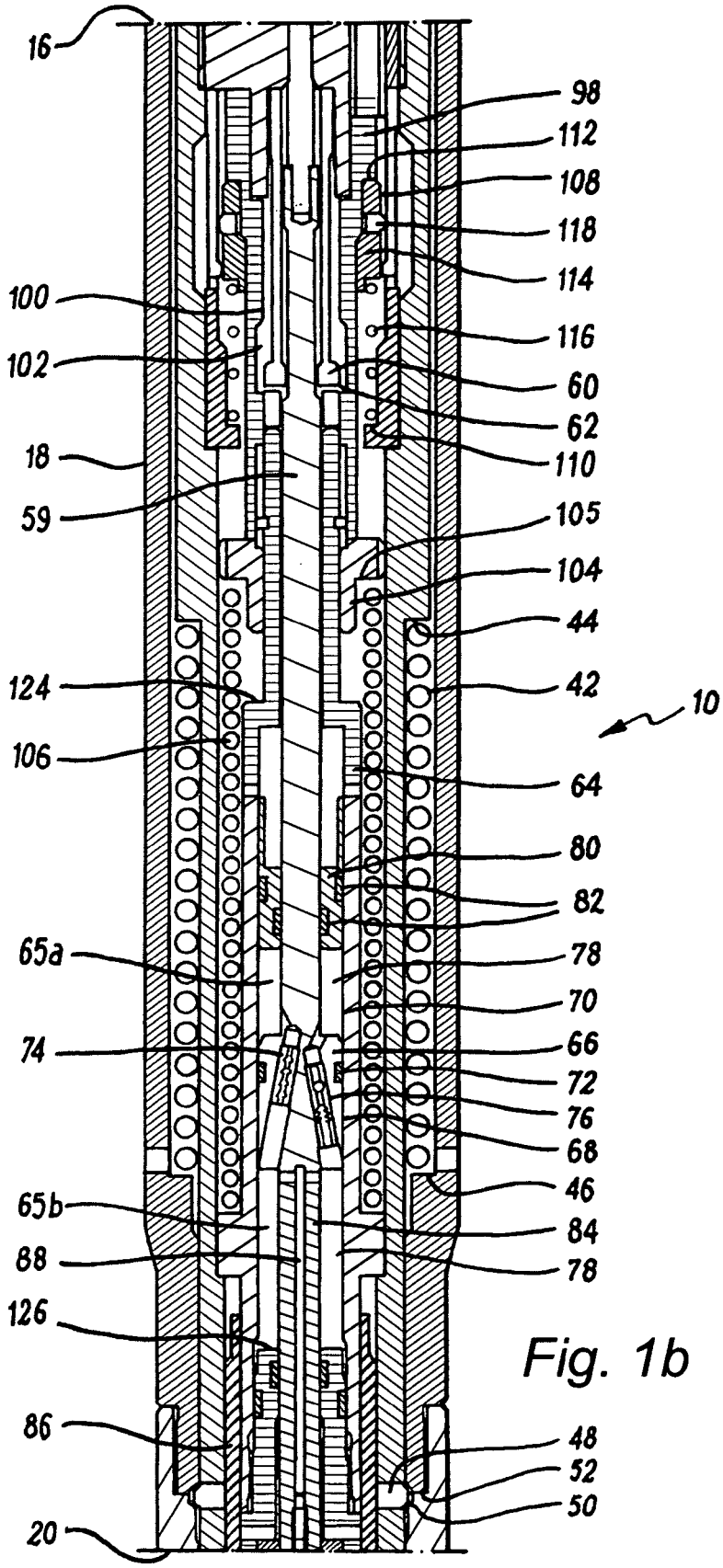
Figure 1C:
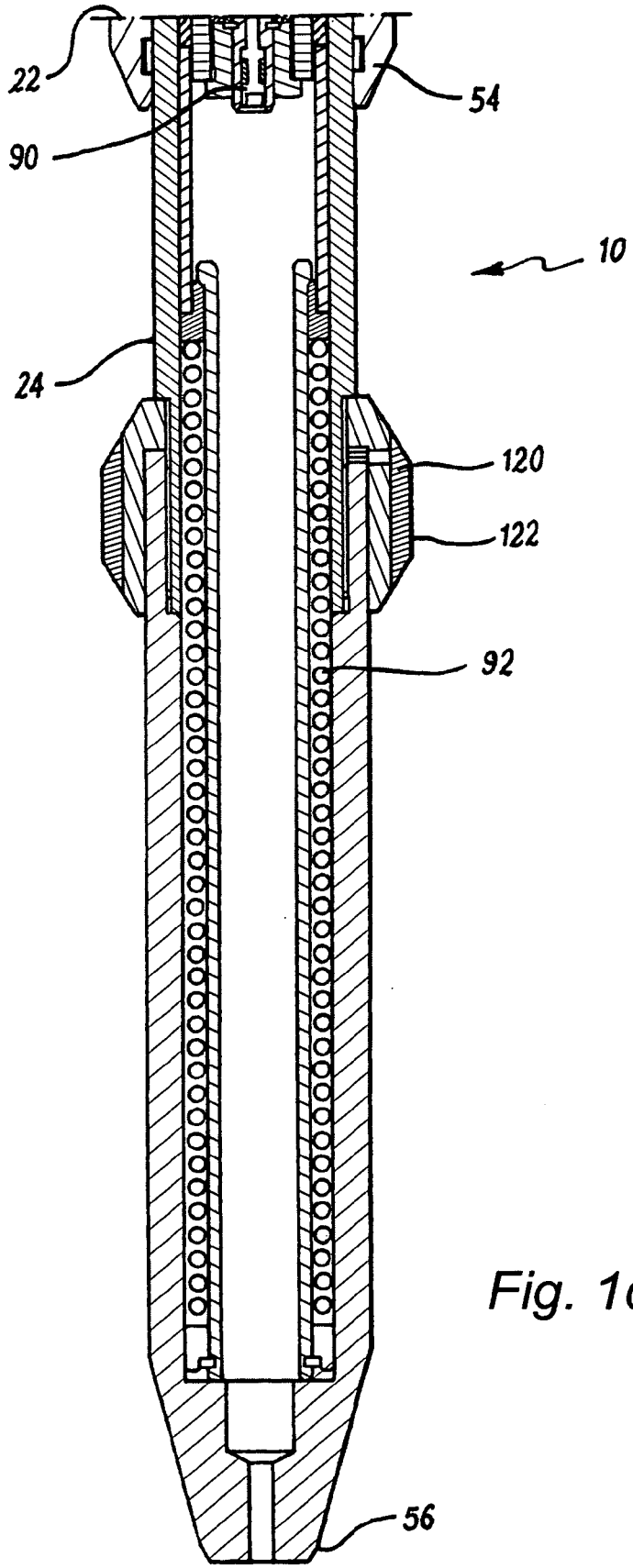

Referring initially to FIGS. 1(*a*), (*b*) and (*c*) there is illustrated a plug, generally indicated by reference numeral 10, according to a first embodiment of the present invention. It will be appreciated that the sections 14,18,24 shown in FIGS. 1(*a*), (*b*) and (*c*) are spliced together to form a single plug where a base 12 of the section 14 meets the top 16 of section 18 and a base 20 of section 18 meets a top 22 of section 24. Thus a full plug 10 is illustrated.

Plug 10 comprises a substantially cylindrical body assembly 26 on which is located an outer sleeve 28. At an upper end 30 of the body 26 there is located a threaded connector 32 for joining the plug 10 to an anchoring device located on a work string (not shown). It will be appreciated by those skilled in the art that such an anchoring device may be a packer or other sealing element such that fluid is prevented from travelling up through the well bore from a location at the plug unless it travels through the plug into the work string.

Body 26 comprises an upper bore portion 34 for continuance of the bore of the work string. Through the body 26 are arranged four circumferentially spaced radial flow ports 36 *a-d*. It will be appreciated that the size of these ports may be selected to determine a flow area for fluid from the outer surface 38 of the plug 10 to the bore portion 34 and thereon through the work string. Flow ports 36 are angled downwards to enhance the passage of fluid flow.

The ports 36 are opened or closed via movement of the outer sleeve 28. Seals 40*a,b* further prevent any fluid flow between the ports 36 and the outer surface 38 when the sleeve 28 covers the ports 36. Outer sleeve 28 is biased to the open position by virtue of a compression spring 42 located between a shoulder 44 of the body 26 and a shoulder 46 on the sleeve 28. A shoulder sleeve 54 is located at a base 52 of the outer sleeve 28. The outer sleeve 28 is retained in position by locking keys 48 positioned on the body 26 which locate within a groove 50 formed at the base 52 of the outer sleeve 28 and the shoulder sleeve 54. It will be appreciated that there may be one or more locking keys 48 arranged circumferentially around the body 26 of the plug 10. On movement of the locking keys 48, the outer sleeve 28 and support sleeve 54 can move together on the outer surface 38. Movement is as described hereinafter with reference to the further Figures.

Arranged axially within the body 26 is a primary piston 58. Piston 58 includes a conically arranged face 60 upon which fluid can act. The shape of the face 60 is selected to help allow the piston 58 to return even when sand or other soft debris has settled above. Piston 58 thereafter comprises a shaft 59 running through a central portion of the plug 10. Surrounding the shaft 59 is a locking collet 60. Locking collet 60 comprises three dogs 62, although only two are shown in cross-section, which are arranged around the piston 58 while being connected to the body 26. Piston 58 thereafter passes into a metering chamber 64.

Within the metering chamber 64, a portion 66 of the shaft 59 is broadened in circumference so that the outer wall 68 of the portion 66 touches the inner wall 70 of the chamber 64. Seals 72 prevent the passage of fluid through the chamber around the piston 58 at this point. Chamber 64 is filled with hydraulic fluid 78. A fluid restrictor 74 and a check valve 76 are arranged longitudinally through the portion 66. The fluid restrictor 74 and check valve 76 control the passage of fluid flow within the chamber 64 between an upper compartment 65*a* and a lower compartment 65*b*. As piston 58 moves downwards, fluid flows through restrictor 74 and dampens the movement of the piston 58.

While the restrictor 74 and valve 76 are illustrated at an angle to a central axis through the plug, it will be appreciated that they could be arranged parallel to the axis. In this way they may be independently supported on the shaft 59.

Located in the upper compartment 65*a* of the chamber 64 is a balance piston 80. Piston 80 surrounds the shaft 59 and contacts the wall 70 of the chamber 64. O-rings 82 provide a seal against the wall 70 while allowing the piston 80 to be free to move within the chamber 64 in either direction to compensate for thermal effects and pressure differences between the inside and the outside of the chamber 64. Thus the balance piston 80 ensures that the behaviour of the fluid restrictor 74 and check valve 76 is uniform regardless of the operating temperature and pressure in the plug 10.

The primary piston 58 exits the chamber 64 and is terminated after a short length by a bleed screw 90 arranged in its base. The bleed screw 90 provides access through the piston 58 to the chamber 64 so that hydraulic fluid 78 can be introduced and bled off. At its base, the primary piston 58 is connected to a support sleeve 86. The support sleeve 86 abuts the rear of the locking keys 48 and pushes them in to the grooves 50. At a base of the support sleeve 86 is positioned a return spring 92 which biases the piston 58 towards the top 30 of the plug 10.

Located adjacent and in parallel to the primary piston 58 is a locking piston 94. Piston 94 also has a conically arranged face 96. In an embodiment, the piston face 96 may be identical to the face 60 of the primary piston 58. This ensures that the pistons 58,94 will act together when pressure is first applied to their faces 60,96.

Piston 94 abuts a locking sleeve 98. On an inner surface 100 of the locking sleeve 98 is a longitudinal recess 102 in which the dogs 62 of the locking collet 60 may locate to allow them to be in a natural state. At a base 104 of the locking sleeve 98 is shoulder 105 against which is arranged a return spring 106 which biases the locking piston 94 toward the top 30 of the plug 10.

A secondary collet 108 is arranged around the locking sleeve 98. Located below the collet 108 is a retaining shoulder 110. Opposite and above the retaining shoulder 110 is a further retaining shoulder 112 located on the locking sleeve 98. Contained between the retaining shoulders 110,112 is a circumferential key retainer 114 biased towards the further retaining shoulder 112 by a return spring 116 abutting the retaining shoulder 110. Keys 118 are mounted on the key retainer 114, protruding toward the collet 108. Excepting the collet 108, these components form an easy return mechanism for the locking piston 94 as will be described hereinafter with reference to the operation of the plug 10.

A further feature of the plug 10 is a centraliser 120 mounted on the outer surface 38 of the body 26 towards the bottom end 56. Centraliser 120 is of known construction providing a plurality of longitudinally arranged blades 122 which can abut walls of the well and ensure the plug 10 is centralised with respect to the well bore.

In use, the plug 10 is arranged as shown in FIG. 1 and as described above. The end faces 60,96 of pistons 58,94 locate in the bore 34 at the same horizontal position. The return springs 92, 106, 116 are at maximum extension so the pistons 58,94 are fully biased. The portion 66 of the primary piston 58 is located centrally in the chamber 64. The support sleeve 86 is supporting the locking keys 48 into grooves 50. Outer sleeve 28 is therefore locked in a closed position with the ports 36 covered by the sleeve. In this 'natural' state the plug 10 is connected to an anchoring device as discussed above and run into a well bore.

When the anchoring device seals off the well bore between the production tubing inner diameter and the plug body 26, pressure can be applied to the plug 10 by the flow of fluid downwards through the work string. This applied fluid pressure will act upon the faces 60,96 of the pistons 58,94 uniformly. Locking piston 94 will travel downwards faster than primary piston 58. This is because as primary piston 58 moves downwards, hydraulic fluid 78 must pass through the restrictor 74 and thus passage of the piston 58 is dampened.

Figure 2A:
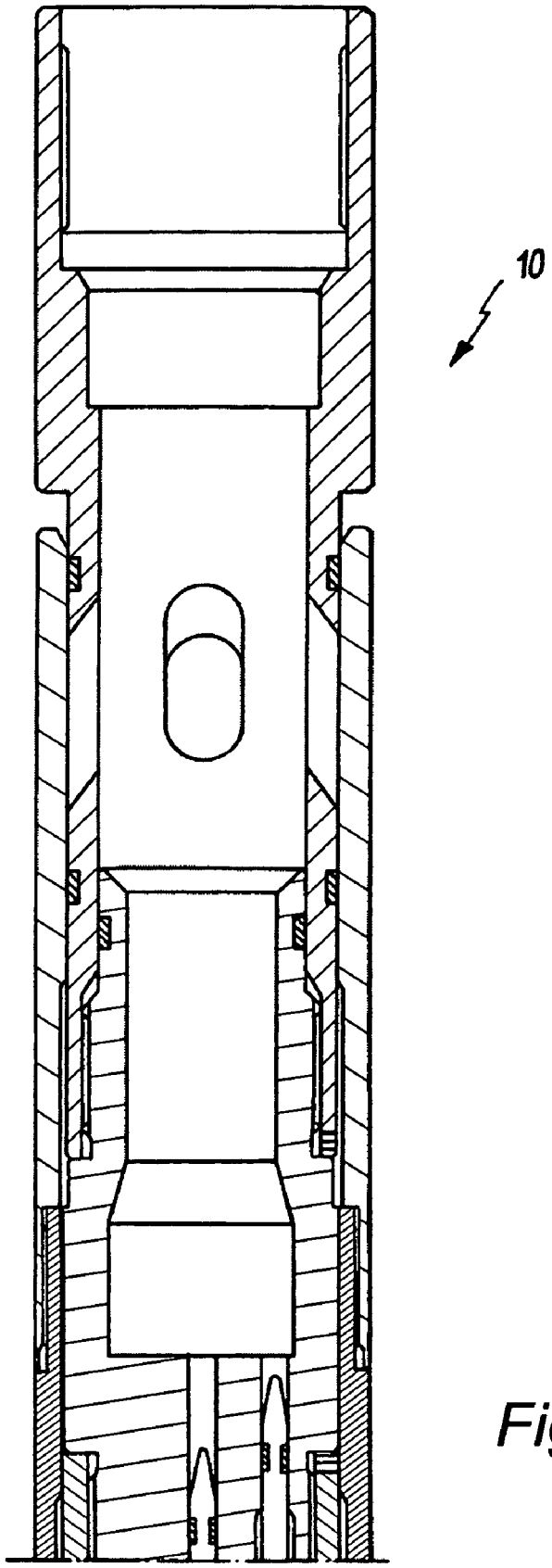
FIG. 2 is a cross-sectional view of the plug of FIG. 1 in parts (*a*), (*b*) and (*c*) of the plug in a locked out, closed state.
Figure 2B:
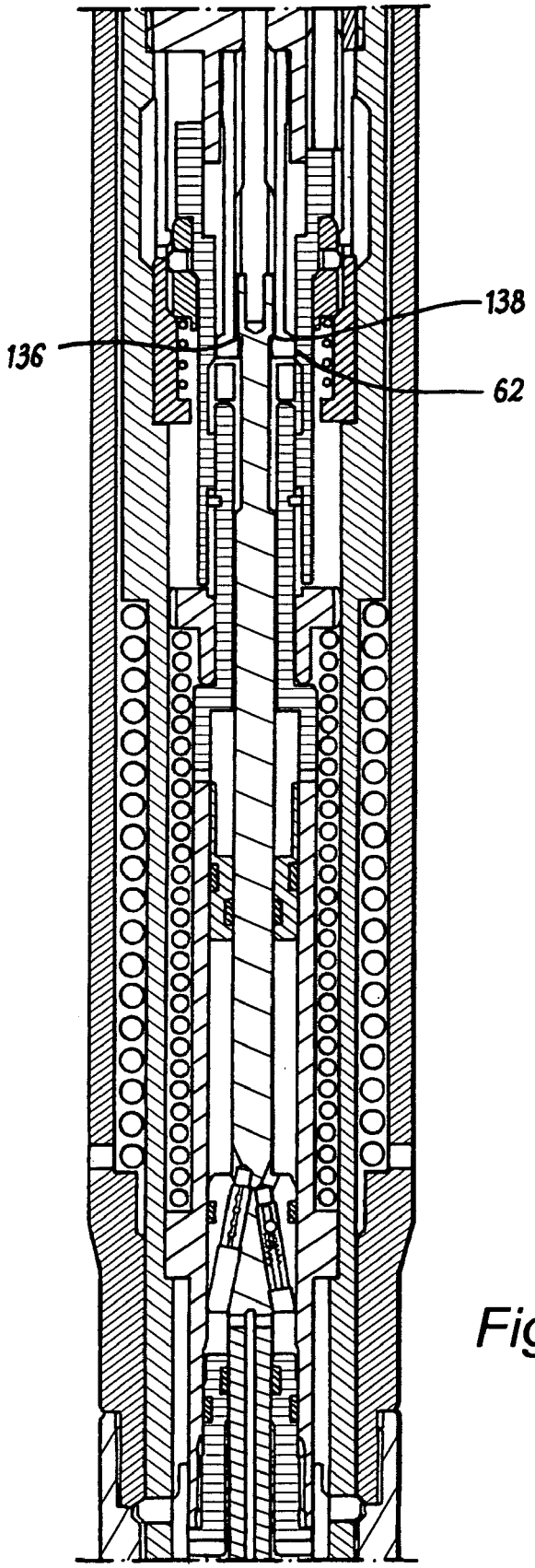
Figure 2C:
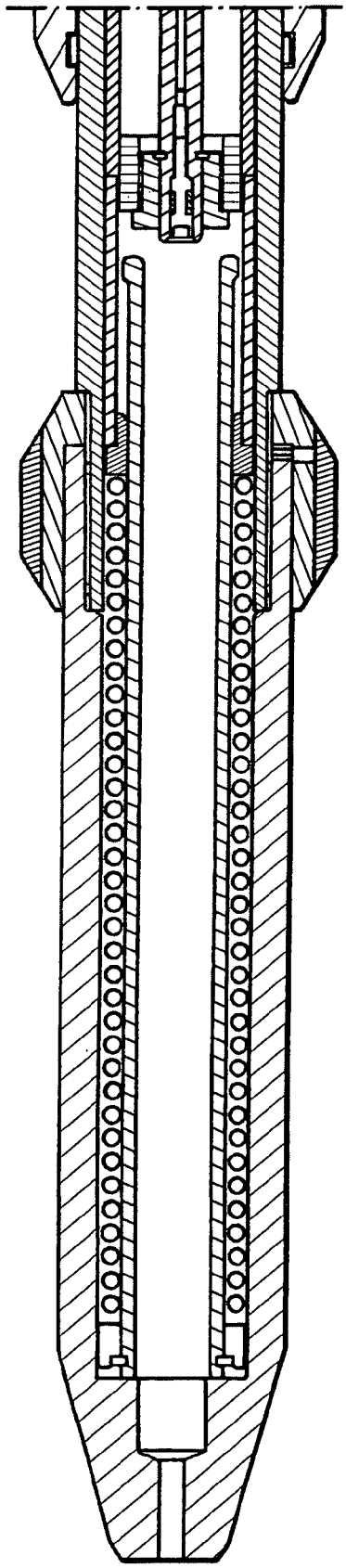
Figure 3A:
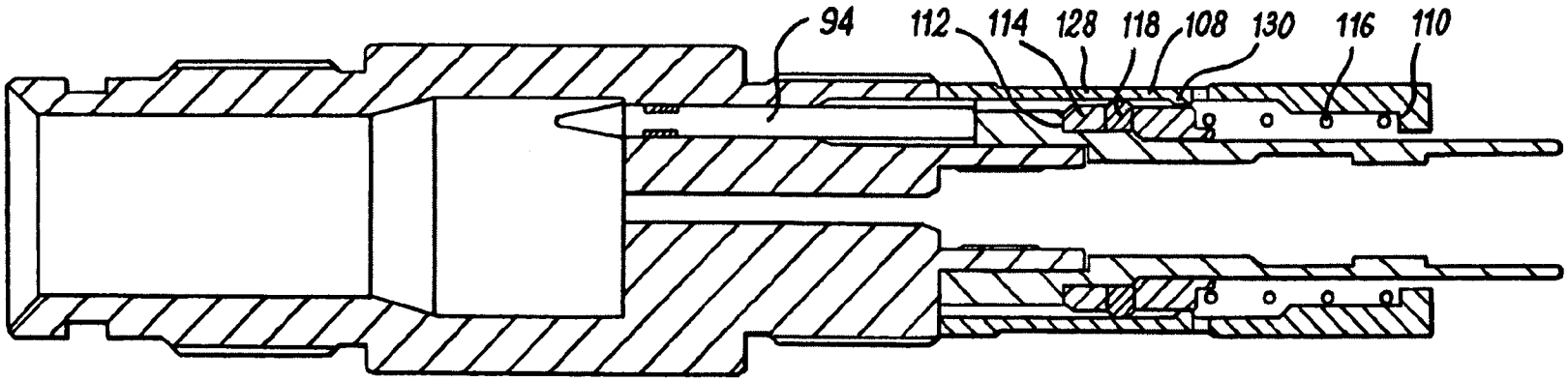
FIG. 3 (*a*)-(*d*) are part cross-sectional views of the plug of FIG. 1 illustrating the locking out procedure.
Figure 3B:
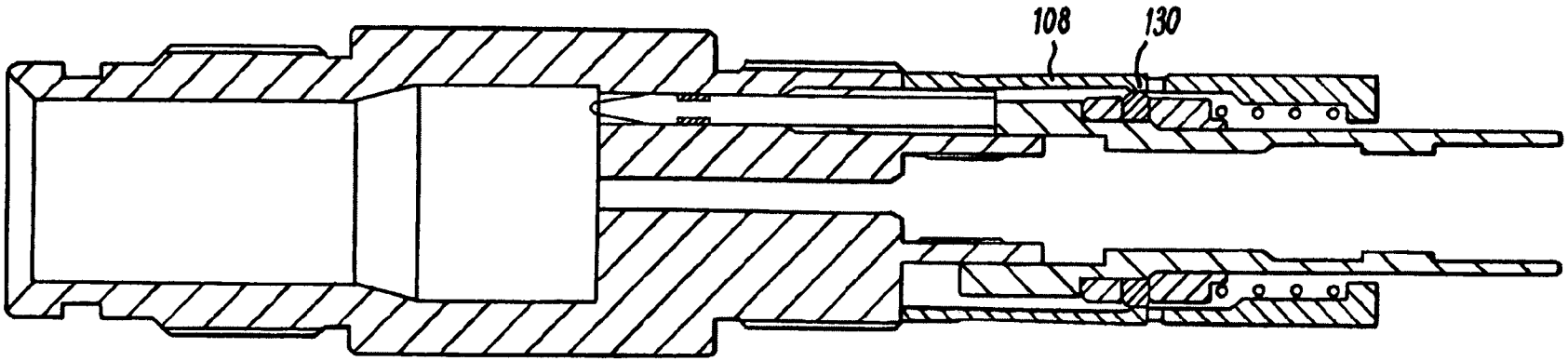
Figure 3C:
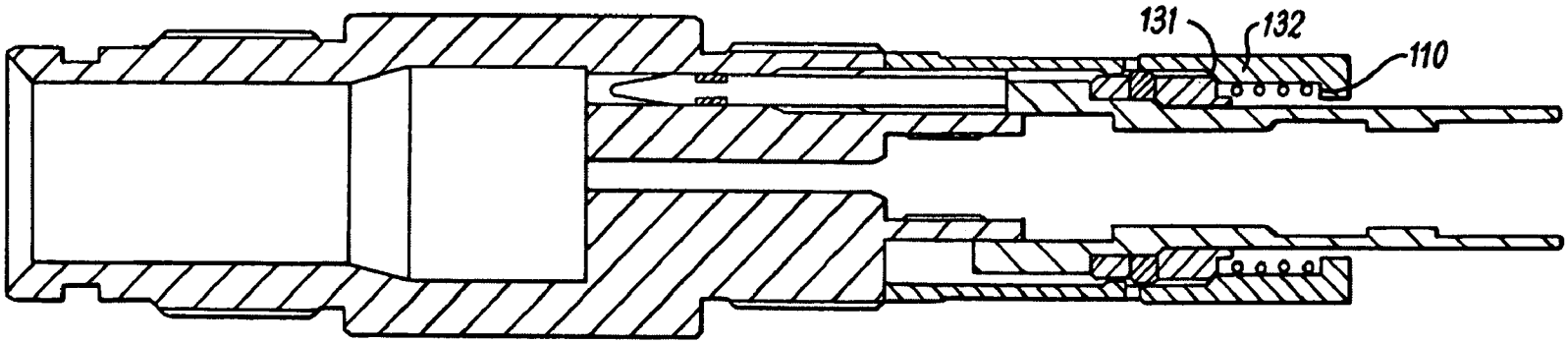
Figure 3D:
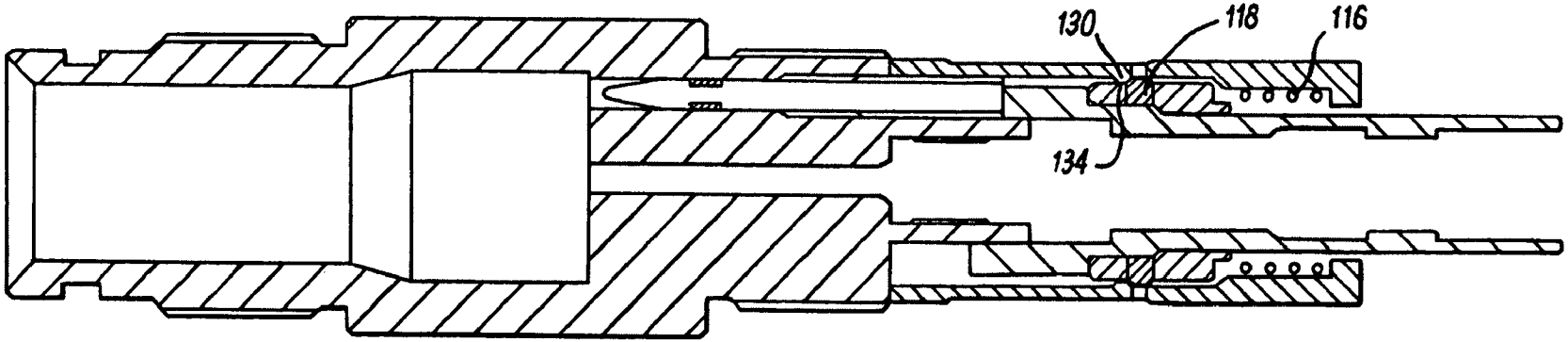

If the pressure applied is sufficient to move the locking piston 94 downwards until the base 105 meets a top 124 of the chamber 64, before the portion 66 of the primary piston 58 reaches the bottom 126 of the chamber 64, the plug 10 moves to a locked position. This is illustrated in FIG. 2.

Reference is now made to FIG. 3 of the drawings which illustrates the key 118/collet 108 interaction which locks the primary piston in position. Like parts between the Figures have been given the same reference numerals to aid clarity. FIG. 3(*a*) shows the relationship of the components in the natural state. Key retainer 114 is biased against shoulder 112 by return spring 116. The keys 118 are free to move along an inner surface 128 of the collet 108. Pressure applied to the piston 94, forces the keys 118 downwards with respect to the collet 108 against the spring 116. The keys 118 push the dogs 130 of the collet 108 outwards as illustrated in FIG. 3(*b*). Continual pressure moves the keys 118 under the dogs 130 and downwards until the retainer ring 114 bottoms out on a shoulder 131 located on a mount 132 for the retaining shoulder 110. This is illustrated in FIG. 3(*c*). The keys 118 are prevented from moving toward the top 30 of the plug 10, such as would occur during pressure bleed down, by virtue of the keys 118 meeting the underside 134 of the dogs 130. This is illustrated in FIG. 3(*d*).

Figure 4:
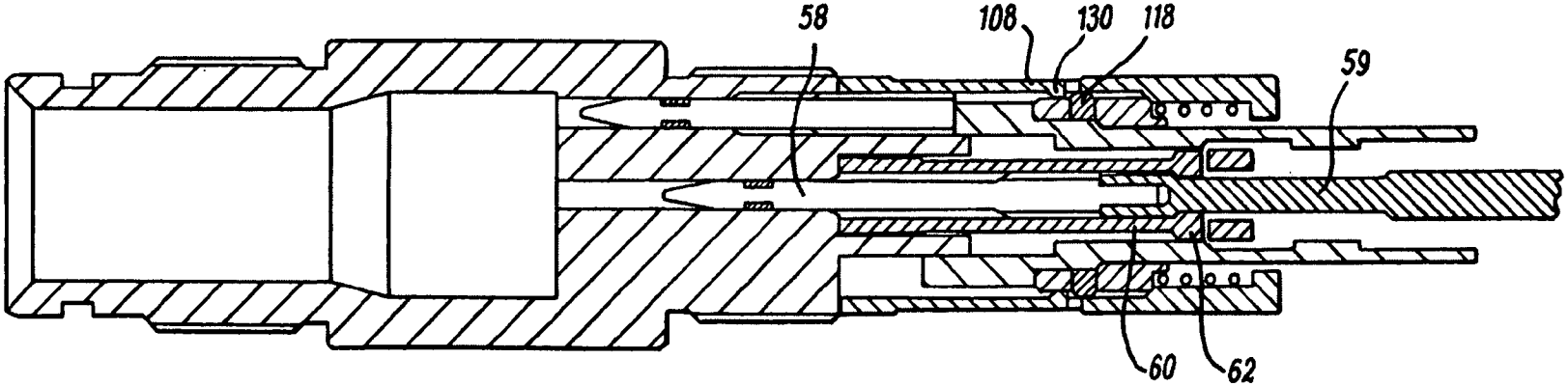
FIG. 4 is a part cross-sectional view through the plug of FIG. 1 in the locked out state.

Returning to FIG. 2, it can be seen that as the retaining ring 114 bottoms out, the dogs 62 engage the primary piston 58, locking it in position. A circumferential lip 136 on the shaft 59 further prevents the primary piston from downward movement by abutting to surfaces 138 of the dogs 62. This is illustrated in FIG. 4. It is noted that outer sleeve 28 remains in the same locked position when the primary piston is locked out. Thus the ports 36 remain closed. In this position, pressure testing can be performed above the plug 10 on the work string. Excess pressure applied to the plug 10 from above will merely hold the tool more tightly in the locked position.

Figure 6:
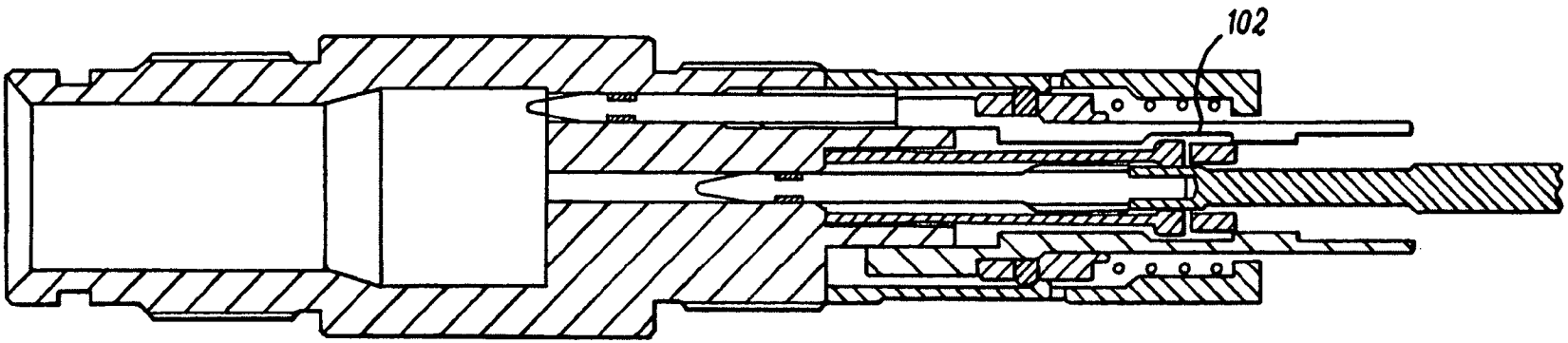
FIG. 6 is a part cross-sectional views through the plug of FIG. 1 in the open state.

If the applied pressure is raised to within a predetermined range when the plug 10 is run in, the plug can be opened. The predetermined pressure range is set by the strength of the collet 108. Returning to FIG. 1, when pressure is applied the two pistons 58,94 move as described above. When the keys 118 reach the dogs 130 of collet 108, they are held there if the pressure is in the predetermined range. The locking piston 94 is thus held at this location as the key retainer 114 abuts the retaining shoulder 112. There is no such restriction on the primary piston 58 and it will travel downwards on its damped path. As long as the pressure is maintained in the predetermined range, after a period of time, the primary piston will reach a final position as illustrated in FIG. 6. The period of time is the time it takes to meter the hydraulic fluid 78 through the restrictor 74. This can be set by the size of the restrictor 74, taking note of the damping required to the primary piston 58.

In a preferred embodiment, the predetermined range is a relatively low pressure of 1200-1800 psi and the time period is approximately 10 mins. Thus holding the pressure on the plug 10 to within the predetermined range for the time period allows the primary piston to reach its final position.

Figure 5A:
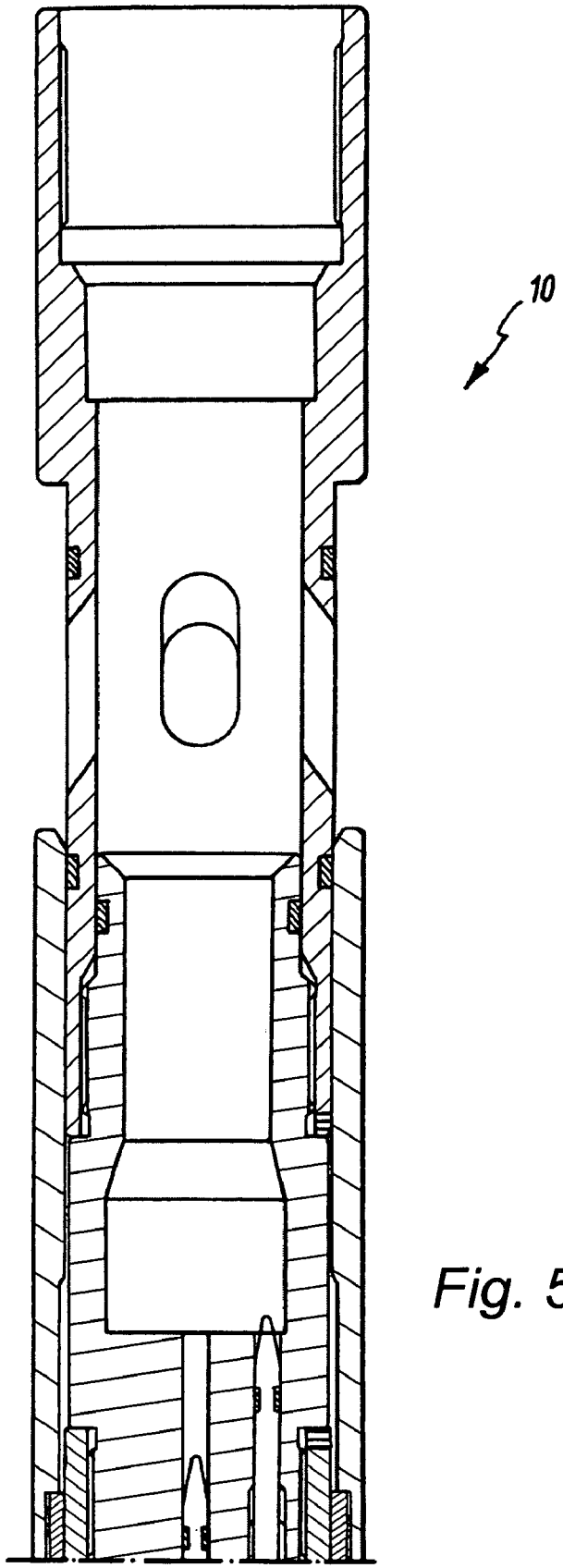
FIG. 5 is a cross-sectional view of the plug of FIG. 1 in parts (*a*), (*b*) and (*c*) wherein the plug is now in the open state.
Figure 5B:
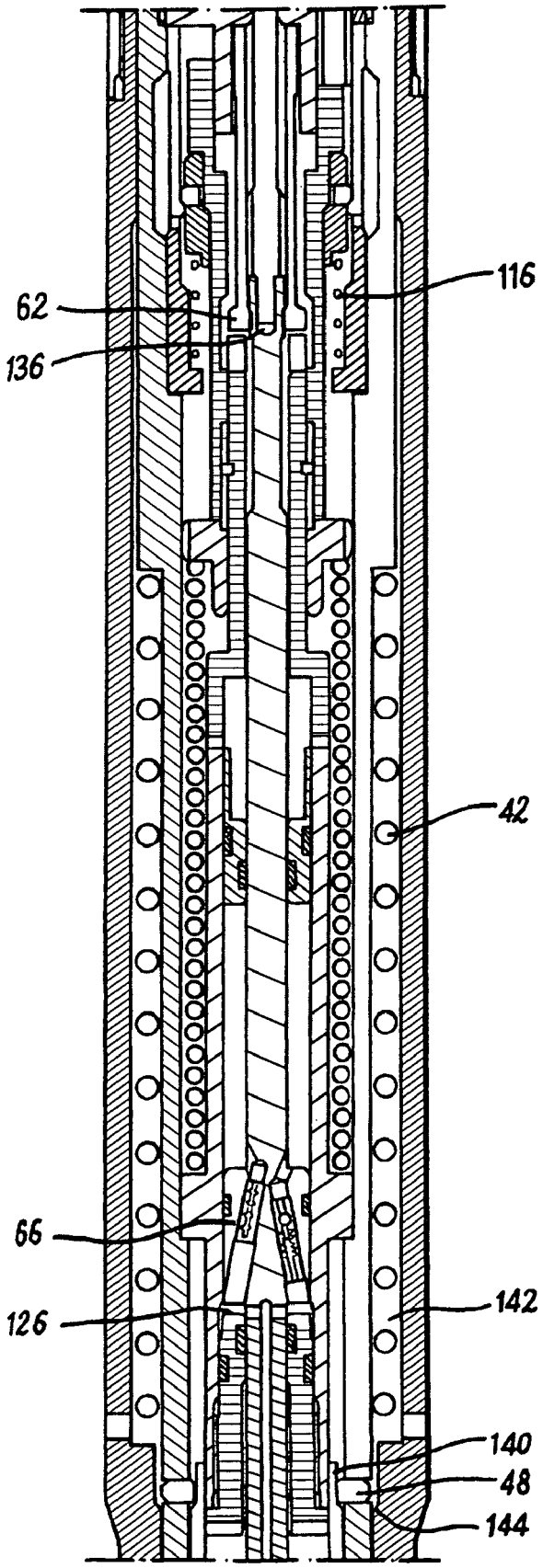
Figure 5C:
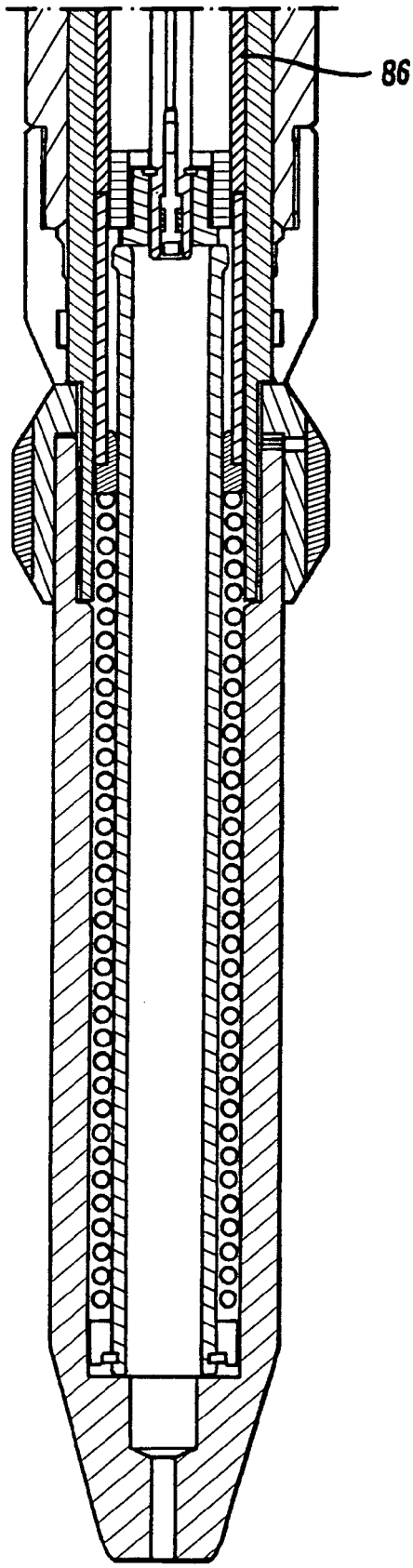

Referring now to FIG. 5, the lip 136 of the shaft 59 has passed the dogs 62 of the locking collet 60. The dogs 62 move outwardly into the groove 102 to allow the piston to pass through unimpeded. The groove 102 locates beside the dogs 62 by virtue of the keys 118 being stopped by the dogs 130 on the collet 108. This is illustrated in FIG. 6. The portion 66 has now reached the base 126 of chamber 64. The support sleeve 86 has move downwards to locate a recess 140 of the sleeve 86 behind the locking keys 48. As a result the locking keys 48 move radially inwards a sufficient distance to unlock the outer sleeve 28 from the body 26. On release of the sleeve 28, spring 42 causes movement of the sleeve 28 downwardly towards the centraliser 120. In the embodiment shown the shoulder 54 abuts the centraliser 120 to prevent further passage of the sleeve 28. On moving the sleeve 28 has uncovered the ports 36. Thus the plug is now open and fluid can flow between the work string, bore 34 and the annulus around the plug 10 in the well bore. Fluid flow may be in an uphole or downhole direction dependant on the pressure within the work string and in the annulus.

To prevent the sleeve 28 from inadvertantly closing over the ports 36, the keys 48 locate into the housing 142 of the spring 42 and abut the shoulder 144.

While the contact sleeve 87 is illustrated as a single sleeve, in an alternative embodiment this sleeve 87 may be two parallel aligned sleeves such that the friction on the keys 48 is reduce as one sleeve remains stationary while the other slides underneath it to release the collet.

While the plug 10 can be opened as the pressure is applied, it is more useful to be able to open the plug 10 after pressure testing has been completed. In order to move the plug from the locked out position, shown in FIG. 2, to the open position, shown in FIG. 5, the applied pressure is bled off to return the pistons 58,94 to their natural state i.e. FIG. 1. Pressure can then be applied as described hereinbefore to open the plug 10.

Figure 7A:
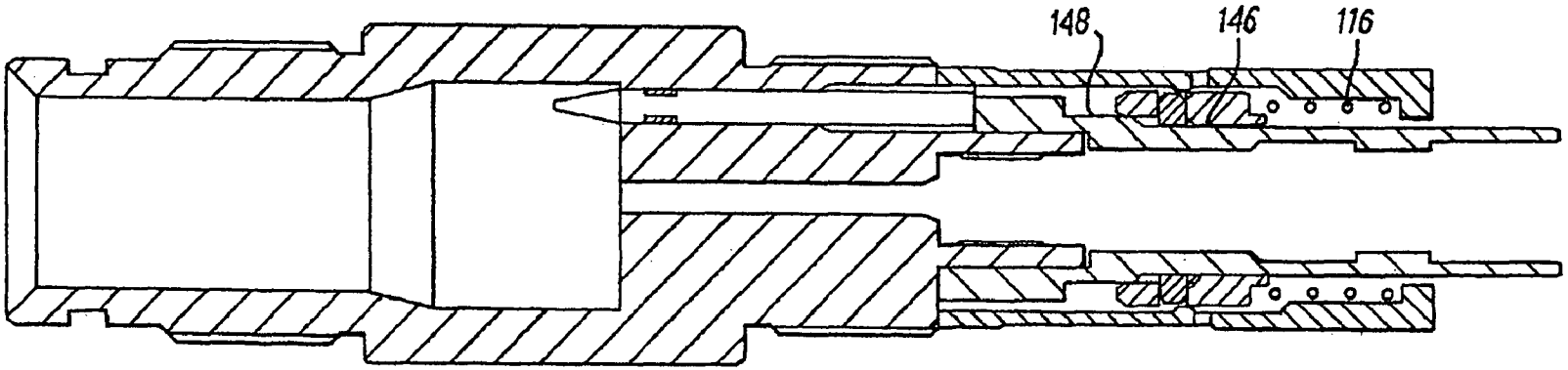
FIGS. 7 (*a*) and (*b*) are part cross-sectional views of the plug of FIG. 1 illustrating the procedure to return to the natural state from the locked out state.
Figure 7B:
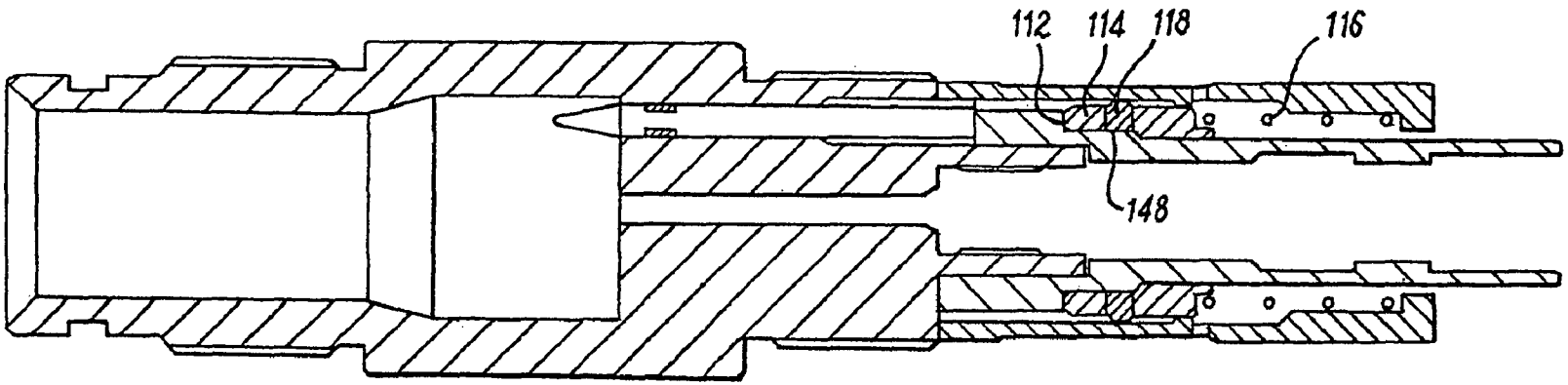

On reducing the pressure, from the locked-out position shown in FIG. 3(*d*), the return spring 116 pushes the key retainer 114 toward the top 30 of the plug 10. The keys 118 ride up to an under surface 134 of the dogs 130. The locking piston return spring 106 biases the locking piston 94 towards the top 30 of the plug 10. This moves locking sleeve 98 upwards relative to the key retainer 114, and the keys 118 are thus arranged against a narrower portion 146 of the sleeve 98. As a result the keys 118 move radially inwards to clear the dogs 130. The spring 116 pushes the key retainer 114 passed the dogs 130. This is as shown in FIG. 7(*a*). Further biasing of the spring 116 causes the keys 118 to move radially outward again as they pass onto the broader portion 148 of the sleeve 98. The key retainer 114 then abuts the shoulder 112. This is as shown in FIG. 7(*b*). This is the easy return mechanism which allows the keys 118 and the key retainer 114 to by-pass the collet 108 easily as the pressure is bled off.

Both pistons 58,94 are now free to move. The return springs 92,106 are designed so that the primary piston 58 returns to its first position ahead of the locking piston 94. Thus the ports 36 advantageously cannot be opened during bleed down. As the piston 58, moves through the chamber 64, hydraulic fluid passes through the uni-directional check valve 76 to fill the lower compartment 65*b*. The return springs 92,106 have built in precompression to compensate for an overbalance up to 2000 psi in a preferred embodiment. The plug 10 is now in the natural state and can be opened as described herein with reference to FIG. 5.

Figure 8A:
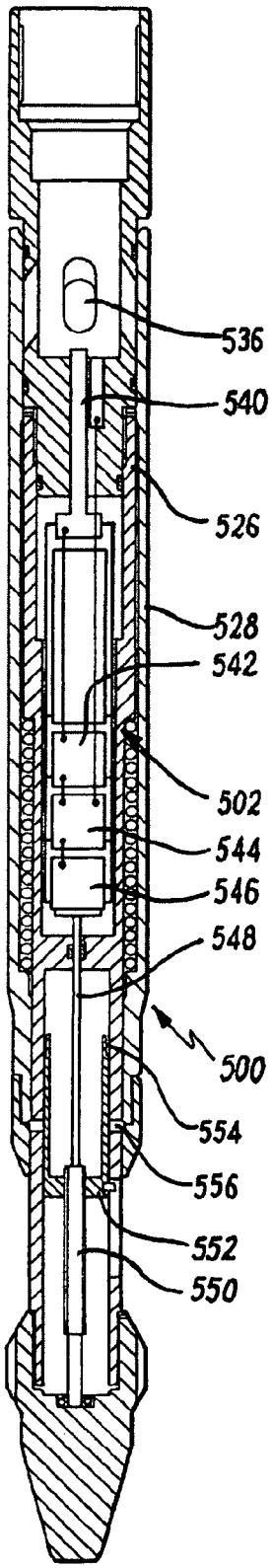
FIG. 8 is a series of schematic cross-sectional views through a plug, illustrating the (*a*) natural state, (*b*) closed state and (*c*) open state, according to a further embodiment of the present invention.
Figure 8B:
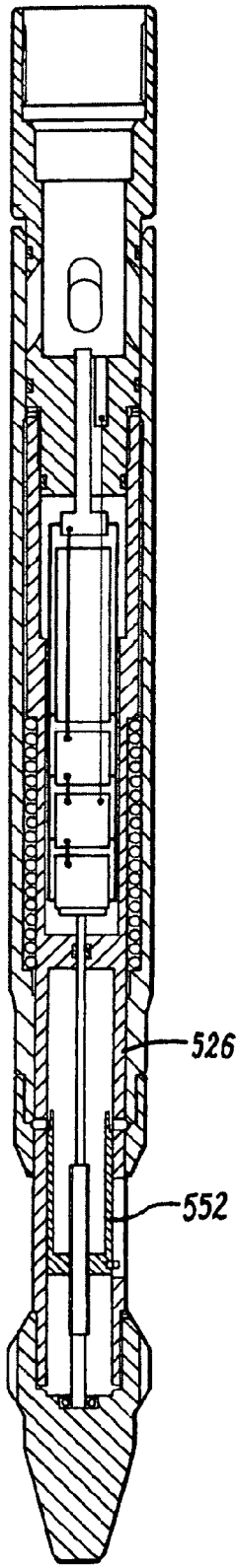
Figure 8C:
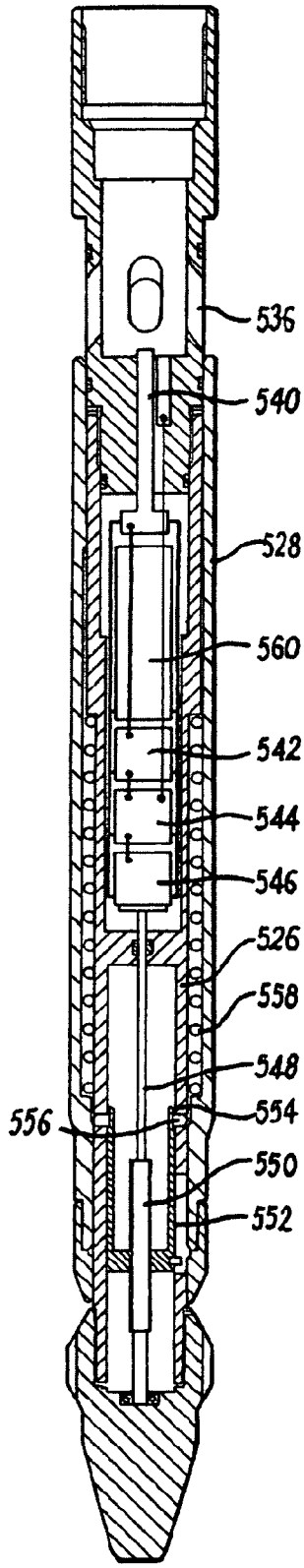

An alternative embodiment of a plug, now referenced as 500, is illustrated in FIG. 8. In this embodiment, the actuating mechanism 502, is now electronic. The plug 500 comprises a cylindrical body 526 on which is located an outer sleeve 528. The body includes radial ports 536 substantially as described hereinbefore for the plug 10.

In this embodiment applied pressure now acts on a pressure sensor 540. Via a pressure transducer 542, the applied pressure is transmitted to a logic processor 544. The logic processor 544 is programmed to hold a motor 546 in a fixed position, FIG. 8(*a*), until the applied pressure is within the predetermined range. When in the range, the logic processor 544 switches on the motor 546 to operate. With the motor on, shaft 548 is rotated and with it a ball screw 550 rotates also. Sleeve 552, threaded upon the ball screw 550, is moved downwards relative to the body 26. If at any time the pressure increases above or below the predetermined range, the motor is stopped and then wound in the opposite direction to move the sleeve 552 back to the original starting point.

If the pressure remains in the predetermined range for a given time period, equated to be the time taken for the motor 546 to move the sleeve 552 over the distance shown between FIGS. 8(*a*) and 8(*b*), the plug can open.

Opening occurs as shown in FIG. 8 (*c*). In this position a recess 554 on the surface of the sleeve 552 is located behind a key 546, on the body 526. The key 546 is drawn radially inwards thus releasing the outer sleeve 528 from the body 526. Spring 558, which had been held in compression between the sleeve 528 and the body 526, then expands. This forces the sleeve 528 downwards relative to the body 526 and the radial ports 536 are opened. The logic processor can also be programmed to reset the plug 500 if desired. While the plug 500 could be powered from the well surface, it is more convenient to use a battery pack 560 which can be located in the body 526.

Figure 9:
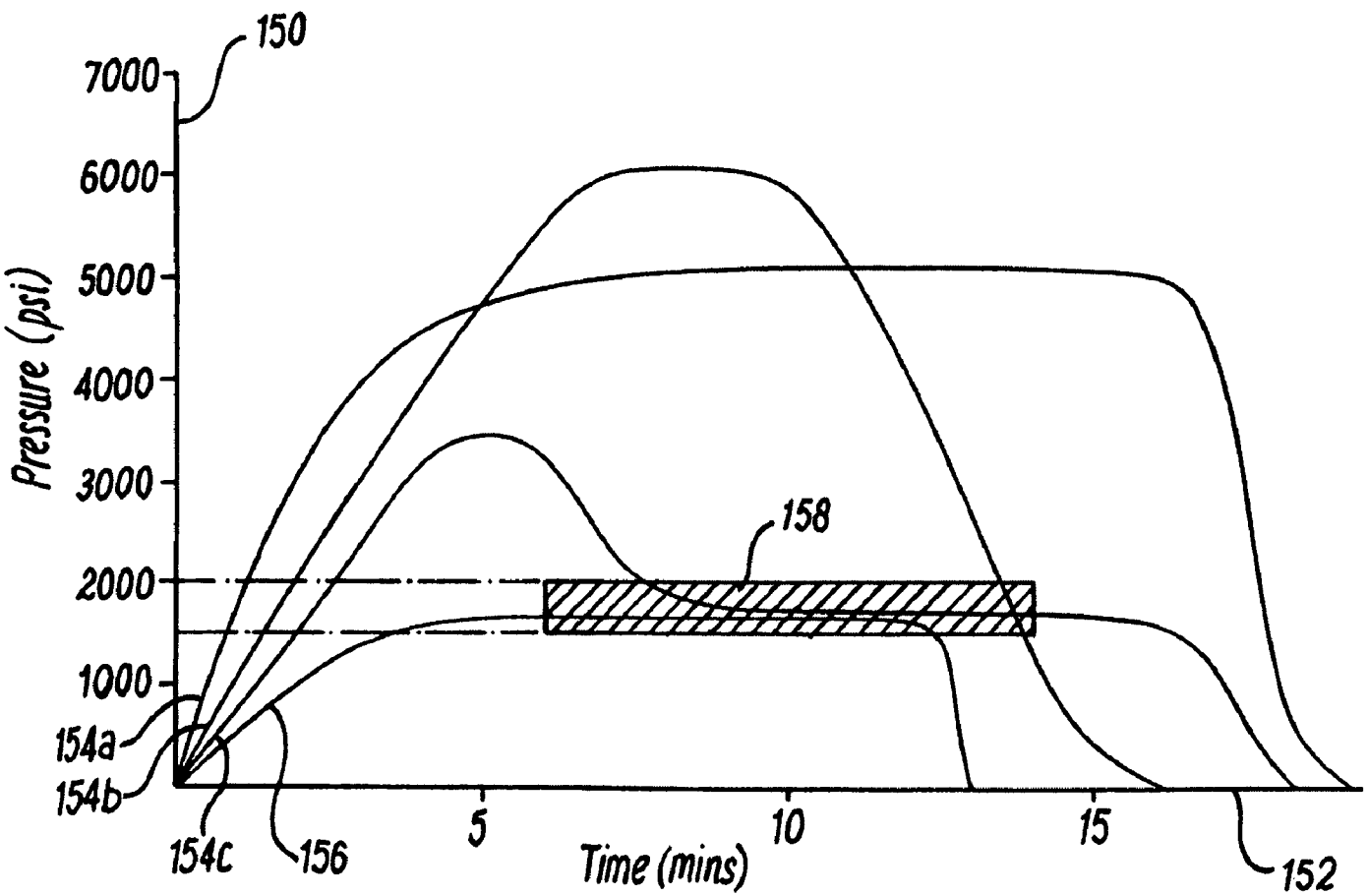
FIG. 9 is a plot of time against applied pressure for three pressure tests and an opening run.

Reference is now made to FIG. 9 of the drawings which shows a graph of applied surface pressure 150 against time 152 for three pressure tests 154*a*-*c* and an opening run 156. A zone 158 is marked as a band in the predetermined pressure range. This is called the open zone and any graph which passes, from low pressure, through the zone 158 continuously for the set time period will result in the plug opening.

Graph 154*a* shows a steep initial applied pressure which does not remain in the zone 158 for a sufficient time. The graph 154*a* then levels off to represent a constant high pressure being applied for a pressure test. The pressure is then bled off rapidly.

Graph 154*b* has a parabolic increase and decrease of pressure illustrating a sharp pressure test, which does not open the plug.

Graph 154*c* illustrates a fast pressure test with an initial rise in pressure above the predetermined range. The pressure is then bled off until it reaches the predetermined range. Once here, although it remains in the zone 158 for the time period, the plug will not open as the pistons were not brought initially back to the natural state.

In graph 156 the pressure is increased until it is within the zone 158. It is then maintained in the zone 158 for the time period and thus this trace illustrates opening the plug.

It can be seen from the Figure that it does not matter if the bleed down traces from a higher pressure, fall through the zone 158, as the plug will already by 'locked out' during the pressure up phase.

The principal advantage of the present invention is that it provides plug which is known to have opened when a pressure is applied in a given range over a set period of time.

Further advantages of an embodiment the present invention are that it provides a plug which can be opened remotely from the surface; can be tested against any amount of times; can be opened when desired and doesn't require a predetermined number of cycles; can operate in both over and underbalanced conditions; is not susceptible to shock loading or inadvertent pressure spikes due to the damping effects of the fluid metering device; opens at a relatively low pressure to minimise damage to the formation; and removes the uncertainty about whether the plug is open or not.

It will be appreciated by those skilled in the art that various modifications may be made to the invention hereindescribed without departing from the scope thereof.

For example, collets have been used to retain and hold the pistons but leaf springs could equally have been used. The number of locking keys can be varied dependent upon the type of tool being used. Further sleeves could be incorporated, for instance, to encase the locking piston return spring 106 to provide easier assembly and added protection to the spring.

The invention claimed is:

1. An actuating mechanism for operating a tool used in a well bore, the mechanism comprising first and second pistons; the first piston including a damping element for delaying movement of the first piston relative to the second piston under an applied pressure; the second piston acting on a retaining element; the retaining element adapted to hold the second piston in an intermediate position when the applied pressure is within a predetermined range and allow movement of the first piston to a final position; the retaining element allowing the second piston to move to a secondary position when the applied pressure is above the predetermined range; a locking element which prevents movement of the first piston when the second piston is in the secondary position; an actuating member whose movement operates the tool; and a securing element for retaining the actuating member in a first position until released by virtue of the first piston reaching the final position, whereby the actuating member moves to a second position and operates the tool.

2. An actuating mechanism as claimed in claim 1 wherein the first and second pistons include substantially conical drive faces with apexes directed towards the applied pressure.

3. An actuating mechanism as claimed in claim 1 wherein the damping element is a fluid metering device.

4. An actuating mechanism as claimed in claim 3 wherein the fluid metering device comprises a fluid filled chamber through which the first piston passes and a portion of the first piston includes a restrictor to regulate fluid flow between upper and lower compartments of the chamber.

5. An actuating mechanism as claimed in claim 4 wherein a pressure balance piston is located in the chamber, around the first piston so as to control the size of the chamber in order to compensate for thermal effects and pressure differences between inside and outside the chamber.

6. An actuating mechanism as claimed in claim 1 wherein the retaining element is a spring.

7. An actuating mechanism as claimed in claim 6 wherein the retaining element is a collet.

8. An actuating mechanism as claimed in claim 1 wherein the locking element is a sleeve such that the retaining element and the locking element engage to control movement of the pistons.

9. An actuating mechanism as claimed in claim 1 wherein the actuating member is a sleeve and the securing element is one or more locking keys which engage with the sleeve.

* * * * *